US005702328A

United States Patent [19]

Mansvelt

[11] Patent Number: 5,702,328

[45] Date of Patent: Dec. 30, 1997

[54] EXERCISING DEVICE

[76] Inventor: Michael Joachim Mansvelt, 11 Jameson Circle Vanes Estate, Uitenhage, South Africa, 6230

[21] Appl. No.: 574,146

[22] Filed: Dec. 18, 1995

[30] Foreign Application Priority Data

Dec. 20, 1994 [ZA] South Africa ..... 94/10110

[51] Int. Cl.[6] ..... A63B 21/068

[52] U.S. Cl. ..... 482/96; 482/97

[58] Field of Search ..... 482/95–97, 72

[56] References Cited

U.S. PATENT DOCUMENTS

| | | | |
|---|---|---|---|
| 345,856 | 7/1886 | O'Brien | 482/96 |
| 4,949,958 | 8/1990 | Richey | 482/96 |

FOREIGN PATENT DOCUMENTS

| | | | |
|---|---|---|---|
| 312934 | 4/1937 | Italy | 482/96 |
| 9325283 | 12/1993 | WIPO | 982/96 |

OTHER PUBLICATIONS

Edge Equipment, Inc. "The Gravity Edge" (brochure) 2 pages.

*Primary Examiner*—Joe Cheng
*Assistant Examiner*—John Mulcahy
*Attorney, Agent, or Firm*—Larson & Taylor

[57] ABSTRACT

An exercise device includes a base part adapted to rest on a floor or another surface. The device includes a first upwardly extending part extending upwardly from the base part and, spaced apart upon the base part, a second upwardly extending part is provided. A lever frame, for supporting a person thereon, is pivoted by way of a pivotation mechanism relative to the first upwardly extending part. An engagement device is provided to act on the second upwardly extending part at a position higher than the lever frame so as to allow a person supported on the lever frame to engage with the engagement device to pivot the lever frame upwardly by way of the pivotation mechanism against the force of the person's weight acting on the lever frame and to thereby lift the person supported on the lever frame.

2 Claims, 6 Drawing Sheets

EXERCISING DEVICE

An exercise device, which includes a support structure; a lever frame for supporting a person thereon; and pivotation means for allowing pivotation of the lever frame relative to the support structure. The device may further include engagement means associated with the lever frame for allowing a person to engage the lever frame to move it counter to the person's weight acting on the lever frame.

FIELD OF INVENTION

The present invention relates to exercising devices.

BACKGROUND TO INVENTION

Numerous body exercising devices are known. These devices often are costly to manufacture and are complicated in construction.

It is an object of the invention to suggest an exercise device which is relatively simple in construction and can be manufactured economically.

SUMMARY OF INVENTION

According to the invention, an exercise device includes a) a base part;

b) a first upwardly extending part extending upwardly from the base part;

c) a second upwardly extending part spaced from the first upwardly extending part and extending upwardly from the base part;

d) a lever frame for supporting a person thereon;

e) pivotation means pivotally supporting the lever frame relative to the first upwardly extending part so that the level frame is located substantially between the first and second upwardly extending parts; and f) engagement means, associated with the second upwardly extending part, for acting on the second upwardly extending part at a position higher than the lever frame so as to allow a person supported on the lever frame to engage with the engagement means to pivot the lever frame upwardly by way of the pivotation means against the force of the person's weight acting on the lever frame and to thereby lift a person supported on the lever frame.

The engagement means may include a first link pivotally connected at one end to the second upwardly extending part; a second link pivotally connected at one end to the lever frame remote from the pivotation means and at its opposite end pivotally connected to the first link between its end pivotally connected to the second upwardly extending part and its free end; and a gripping means associated with the free end of the first link for allowing a person to grip the gripping means to exert an upwardly directed pulling force for pivoting the first link and therewith the lift the second link, to pivot the lever frame about the pivotation means and thus to lift a person supported on the lever frame.

The engagement means may include a pulley system comprising an elongated flexible element connected at one end to the second upwardly directed part at a level higher than the lever frame; a guide member connected to the lever frame remote from the pivotation means for guiding the flexible element around it; and a hand gripping member connected to the flexible element for allowing a person to grip the hand gripping member and to pull it away from the guide member to cause the lever frame to be pivoted about the pivotation means and therewith to lift a person supported on the lever frame.

The engagement means may include a foot engaging member pivotally mounted on the lever frame; a pulley system comprising an elongated flexible element connected at one end to the second upwardly directed part at a level higher than the lever frame; a guide member connected to the lever frame remote from the pivotation means for guiding the flexible element around it; and the flexible element being connected to the foot engaging member for allowing a person supported on the lever frame to pivot the foot engaging member to cause pivotation thereof to exert an upwardly directed force on the lever frame to pivot the lever frame about the pivotation means and thus to lift the person supported on the lever frame.

The engagement means may include a pulley system including an elongated flexible element connected at one end to the second upwardly directed part at a level higher than the lever frame; a guide member connected to the lever frame remote from the pivotation means for guiding the flexible element around it; a sliding member slidably mounted on the lever frame; and the flexible element being connected to the sliding member for allowing a person supported on the lever frame to cause the sliding member to be moved away from the guide member to cause the lever frame to be pivoted upwardly about the pivotation means and thereby to lift a person supported on the lever frame.

The lever frame may be adjustably supported by the pivotation means.

BRIEF DESCRIPTION OF DRAWINGS

The invention will now be described by way of example with reference to the accompanying schematic drawings.

In the drawings there is shown in.

DETAILED DESCRIPTION OF DRAWINGS

Figure 2:
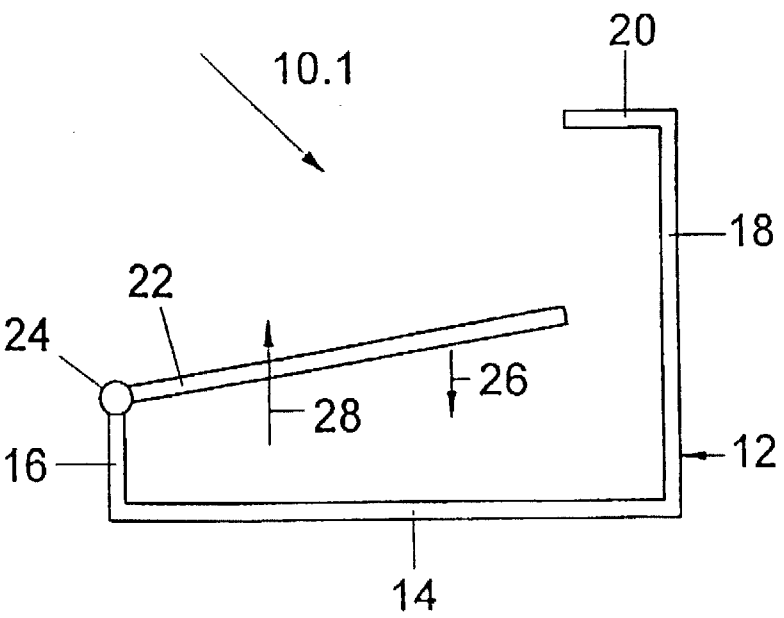
FIG. 2 a view corresponding to FIG. 1 showing the device in an operative position.

In the various drawings the same or similar parts will be identified by the same reference numerals.

Figure 1:
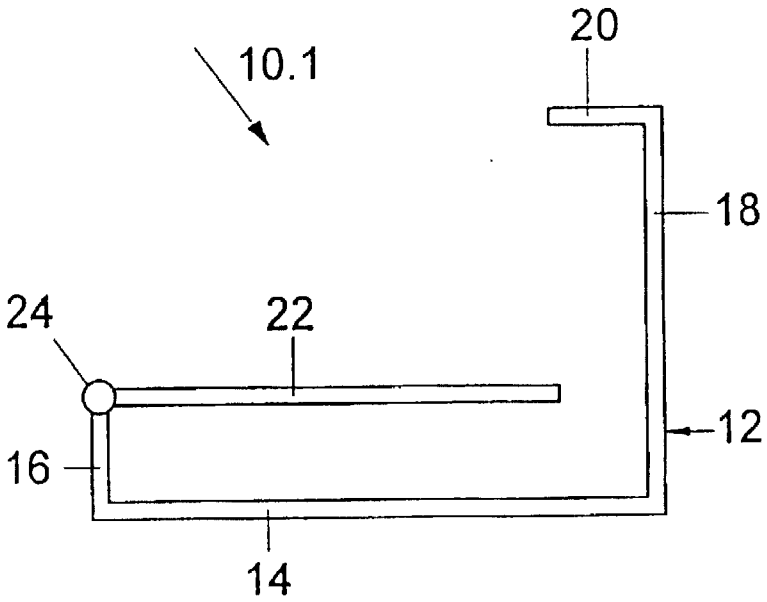
FIG. 1 a side view of a first or basic embodiment of an exercise device in accordance with the invention showing the device in an inoperative position.

Referring to FIGS. 1 and 2 the exercise device in accordance with the invention, generally indicated by reference numeral 10.1, includes a fixed support structure or main frame 12 having a base 14, a vertically extending end arm 16 at one end of the base 14, and a vertically extending end arm 18 at the opposite end of the base 14, the arm 18 supporting at its free end a projecting arm 20 fixed thereto. The device 10.1 further includes a lever frame 22 pivotally mounted by way of pivotation means 24 to the arm 16.

The basic device in accordance with the invention therefore includes, firstly, a main frame 12 (having the components 14, 16, 18, 20), secondly, a lever frame 22 and, thirdly, pivotation means 24.

The lever frame 22 is adapted to support a person doing exercises. This means that the person can sit, lie down or stand on the lever frame 22. The body weight of the person then provides the force which has to be counteracted by the person to pivot the lever frame 22 about the pivotation means 24 and thereby performing exercises.

Although no particular details are shown, the lever frame 22 preferably is limited in its pivotation movement by other stops or by other suitable means incorporated in or associated with the lever frame 22 and/or pivotation means 24.

FIG. 1 shows the device 10.1 in a position of rest or an inoperative position.

As stated above, a person, who wishes to exercise, will sit, stand or lie down on the lever frame 22 so that his weight acts in the direction indicated by arrow 26 shown in FIG. 2.

By applying a pulling force onto the arm 20 the lever arm 22 is pulled in the direction indicated by arrow 28 as shown in FIG. 2 opposite to the action of the force 26. Thereby an exercise movement is executed.

It is emphasised that FIGS. 1 and 2 merely illustrate a basic form of the exercise device in accordance with the invention. Therefore, the connection between a person and the components of the device for transmitting force counter to the direction of the force of the weight of a person can be realised in many different ways and by utilizing various connection means or force transmission means, such as levers, pulleys and cables, slides, or any required combination of these acting on any point on the lever frame 22 to create a force in the direction indicated by arrow 28 and thereby to lift the lever frame 22 as an exercise movement is executed, as is shown in FIG. 2.

A person performing exercises can be "joined" in numerous manners to the lever frame 22, for instance by being seated thereon, by having any suitable engagement means such as a hand gripping member, a foot engagement member, straps and any other suitable means associated with the lever frame 22.

Figure 4:
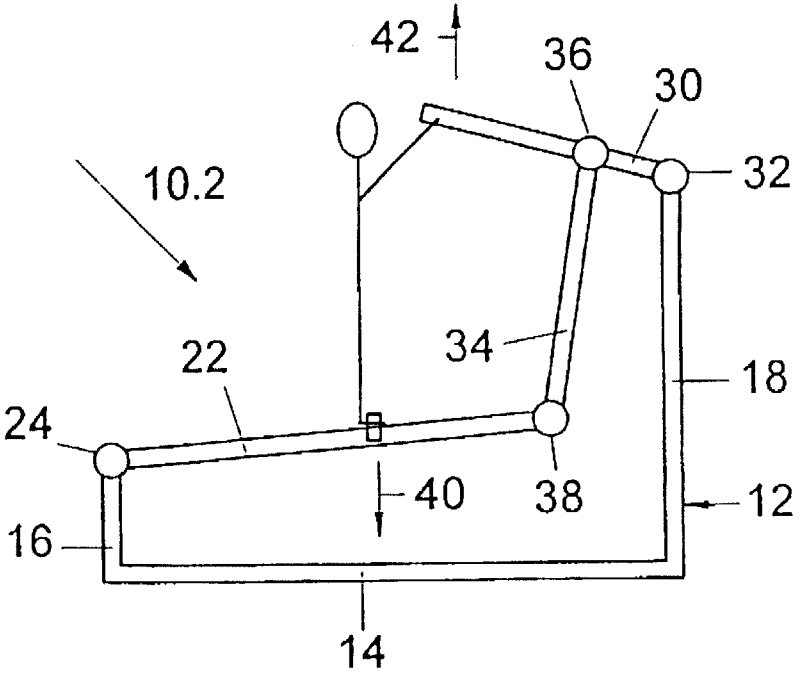
FIG. 4 a view corresponding to FIG. 3 showing the device in an operative position.
Figure 3:
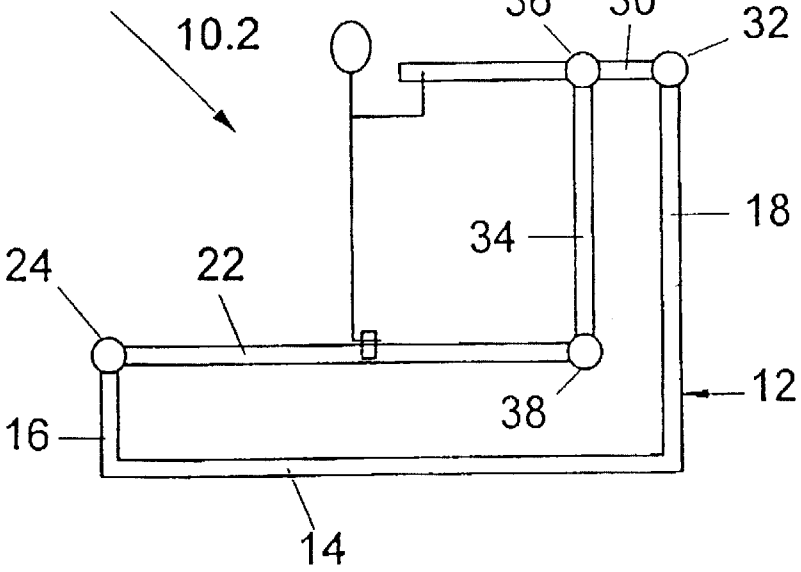
FIG. 3 a side view of a second embodiment of an exercise device in accordance with the invention showing the device in an inoperative position.

Referring to FIGS. 3 and 4, a second embodiment of an exercise device, generally indicated by reference numeral 10.2, is shown.

The device 10.2 shows one example of how force can be transmitted between a person and the various components of the device. The device 10.2 has a second lever arm 30 pivotally mounted at 32 to the arm 18. Furthermore the lever frame 22 has a link 34, which is pivotally connected at 36 to the arm 30 and at 38 to the lever frame 22. The position 36 is in-between the free end of the arm 30 and the pivot point 32.

The weight of a person doing exercises acts in the direction indicated by arrow 40 and by pushing or pressing in the direction indicated by arrow 42 on the lever arm 30, the force acting in the direction opposite to arrow 42 is counteracted and an exercise is executed.

Figure 6:
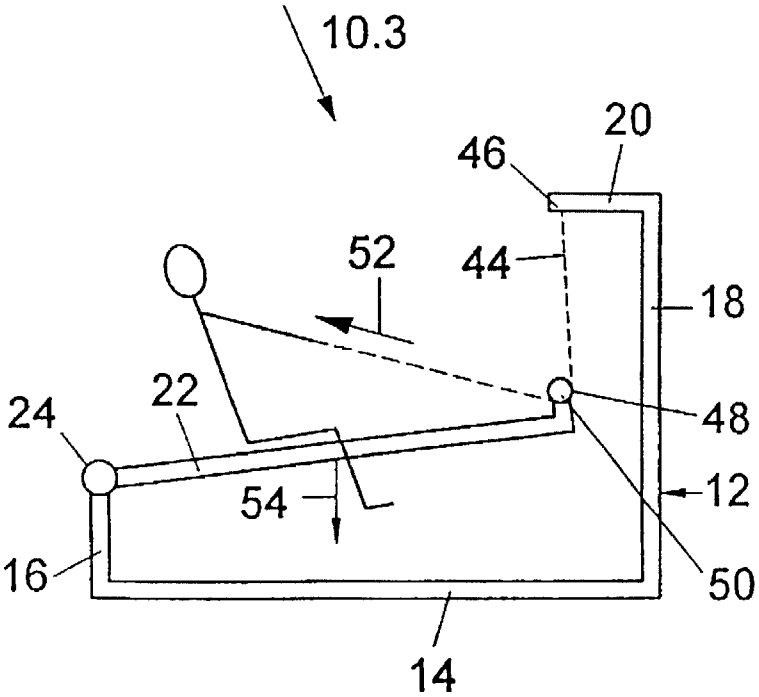
FIG. 6 a view corresponding to FIG. 5 but showing the device in an operative position.
Figure 5:
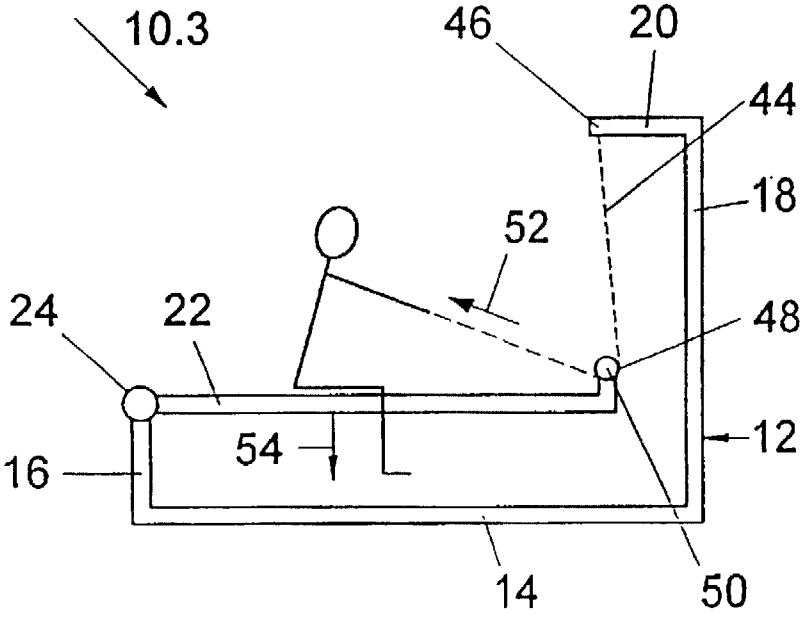
FIG. 5 a side view of a third embodiment of an exercise device in accordance with the invention showing the device in an inoperative position.

Referring to FIGS. 5 and 6 a further development of an exercise device in accordance with the invention is shown. Here the exercise device, generally indicated by reference numeral 10.3, includes a cable 44 connected at 46 to the arm 20 and passing around a pulley 48 rotatably mounted at 50 to the lever frame 22. A person doing exercises pulls at the free end of the cable 44 in the direction as indicated by arrow 52 to perform a pulling exercise, whilst the weight of the person acts in the direction shown by arrow 54. Thereby the lever arm 22, and the person, are lifted counter to the action of the force acting in the direction of arrow 54.

Figure 8:
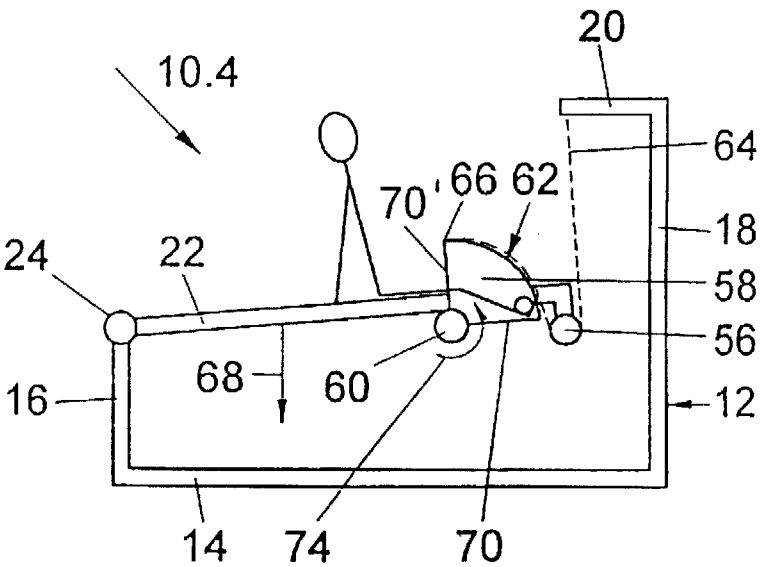
FIG. 8 a view corresponding to FIG. 7 but showing the device in an operative position.
Figure 7:
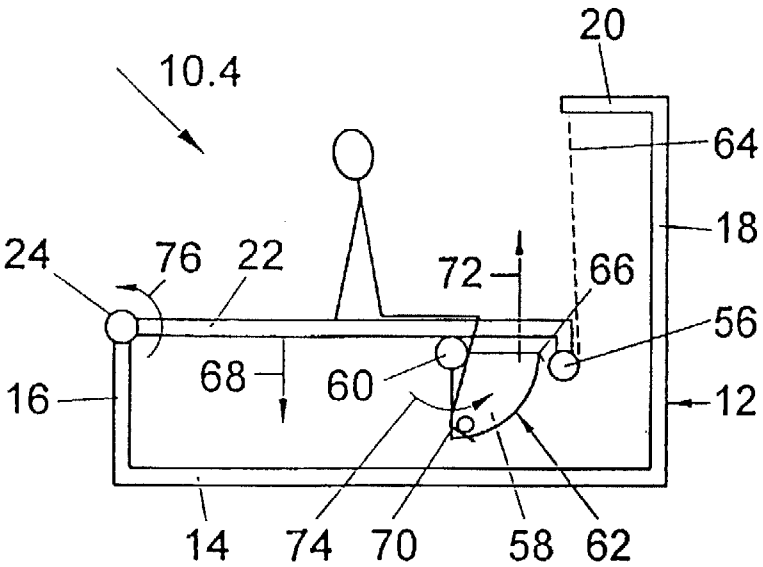
FIG. 7 a side view of a fourth embodiment of an exercise device in accordance with the invention showing the device in an inoperative position.

The exercise device 10.4 illustrated in FIGS. 7 and 8 is intended to provide leg exercises. Here a pulley 56 is rotatably mounted to the free end of the lever frame 22. A segment 58 is pivotably mounted at 60 to the lever arm 22 spaced away from the free end thereof. The segment 58 has a rope guide along its curved edge 62. A rope 64 is attached at one end to the free end of the arm 20, extends around the pulley 56 and is attached at its other end to the segment 58 at the position 66. A person doing exercise will sit on the lever arm 22 so that his weight acts downwardly in the direction of arrow 68. His feet co-operate with foot pads of foam rubber or of any other suitable material provided on the edge 70 of the segment 58. The foot pads are attached to the edge 70, which allows a full movement to be executed. By rotating his legs about the knees in the direction of arrow 72 the segment 58 is rotated about its pivot 60 in the direction indicated by arrow 74. Thereby the rope 64 is pulled by the segment 58 to be guided around the pulley 56 and the lever frame 22 is pivotted in the direction of arrow 76 about the pivotation means 24.

The foot engagement may also be provided at any other suitable position on the segment 58, e.g. along or at the edge 70' of the segment 58.

Figure 9:
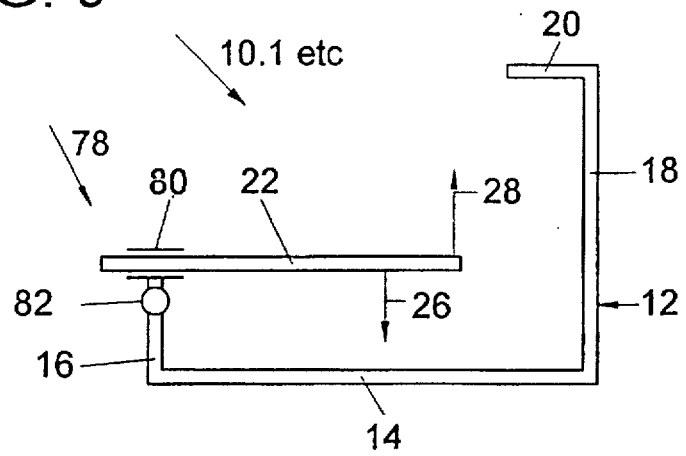
FIG. 9 a side view of a centre of gravity adjusting arrangement which can be incorporated in any of the exercise devices in accordance with the invention, such as illustrated in FIGS. 1 to 8 or FIGS. 12 and 13, the device being shown in a first adjusted position.
Figure 10:
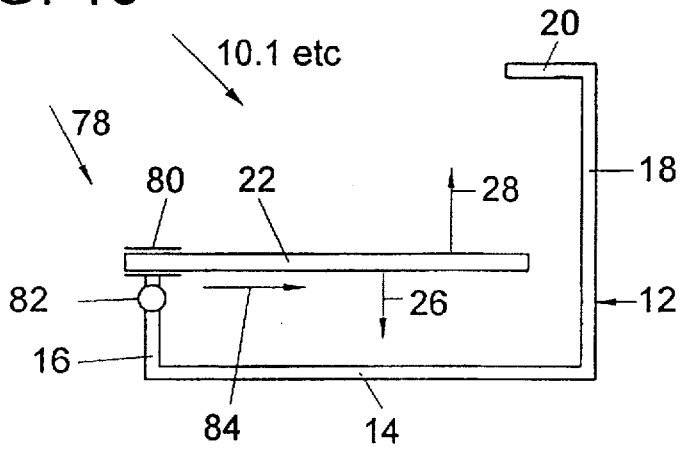
FIG. 10 a view corresponding to FIG. 9 but showing the gravity adjusting arrangement in a second adjusted position.
Figure 11:
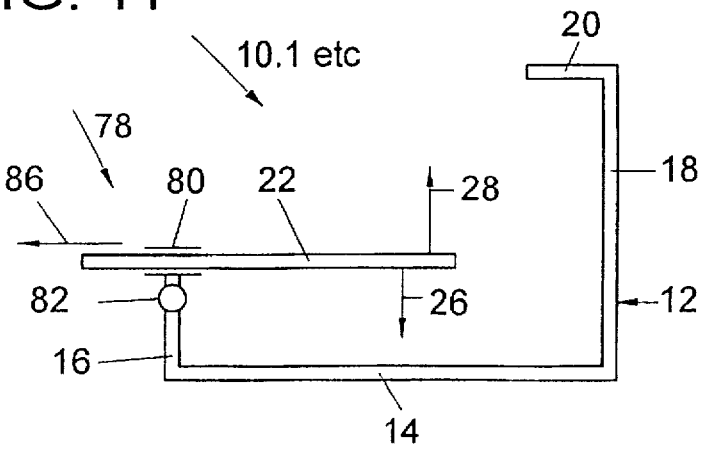
FIG. 11 a view corresponding to FIG. 9 but showing the gravity adjusting arrangement in another adjusted position.

In FIGS. 9 to 11 a centre of gravity adjustment arrangement 78 is illustrated which makes a variation in the forces applicable possible in a simple manner. It can be used with any one of the devices 10.1, 10.2, 10.3, 10.4, 10.5 referred to in FIGS. 1 to 8 and FIGS. 12 and 13 or with any other device in accordance with the invention. As is shown the lever frame 22 is adjustably and slidably mounted in a tube or guide 80, which is pivotably supported on pivotation means 82 carried by the arm 16. As shown in FIG. 10 the lever force is increased by moving the lever frame 22 in the direction of arrow 84, whereas it is decreased by moving in the opposite direction as shown by arrow 86 in FIG. 11.

Figure 12:
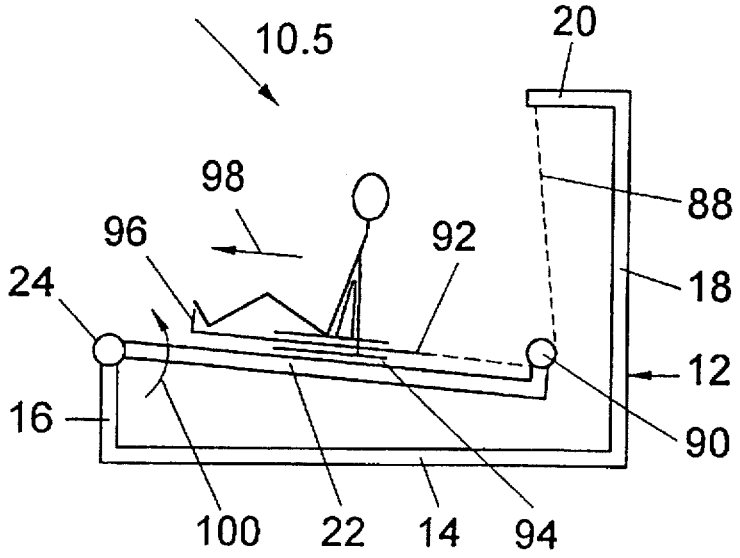
FIG. 12 a side view of an fifth embodiment of an exercise device in accordance with the invention showing the device in an inoperative position.
Figure 13:
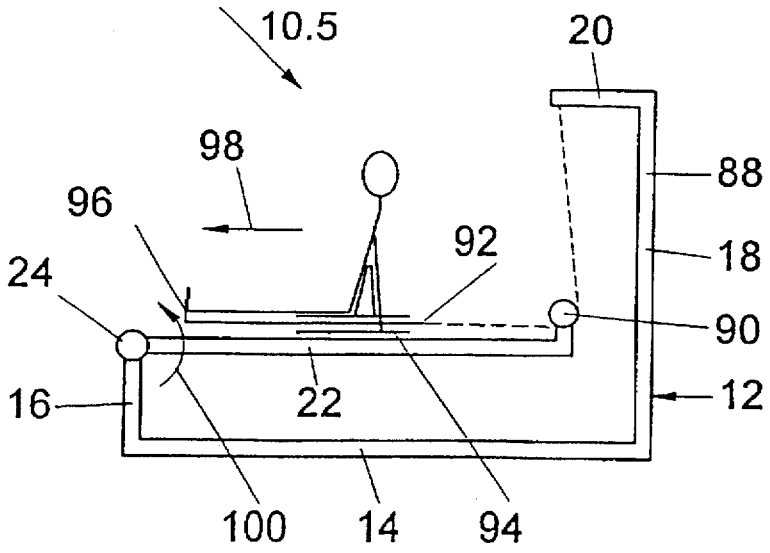
FIG. 13 a view corresponding to FIG. 12 but showing the device in an operative position.

A further exercise device 10.5 is shown in FIGS. 12 and 13. The device 10.5 is a leg press device and includes a rope 88 attached at one end to the arm 20 and passing around a rotatable pulley 90 attached to the free end of the lever frame 22. The other end of the rope 88 is attached to a slide 92 slidably mounted in a tube or guide 94 attached to the lever frame 22. The slide 92 has a foot engagement plate 96 which can be moved in the direction of arrow 98 by a person doing exercises. This will cause the lever frame 22 to pivot in the direction of arrow 100.

It must be noted that any cables in the devices as illustrated may be replaced by a rope, chain or any other suitable flexible element.

By means of the device as illustrated in the various drawings the exercise force can be adjusted by any one or more of the following:

1. Moving the centre of gravity of a person doing the exercise and acting on the lever frame 22.
2. Changing lever lengths to change lever ratios.
3. Moving the position of the pulling force on the lever frame 22 and/or main frame 12.
4. Moving the lever frame 22 through the pivotation means on the main frame 12 to change the effective length of the centre of gravity of the person doing the exercise by way of the gravity adjustment arrangement shown in FIGS. 9, 10, 11.
5. Any combination of the aforegoing.

The exercise force as such is determined by:

1. The mass of the person performing the exercise.
2. The position of the centre of gravity of the person doing the exercise on the lever frame 22.
3. The size of the lever lengths of the lever frame 22.
4. The position of the pulley 38, 48, 56 or 90 on the lever frame 22 and/or the main frame 12.
5. The number of cables used in parallel and the pulley arrangement used to transmit the exercise force to the lever frame 22.

It must be noted that by using the basic construction of the device as illustrated in FIGS. 1 and 2 numerous variations of different exercise devices are possible in order to perform different exercises. It is the intention of the invention also to cover such variations.

I claim:

1. An exercise device, comprising;

a) a base part;

b) a first upwardly extending part extending upwardly from the base part;

c) a second upwardly extending part spaced from the first upwardly extending part and extending upwardly from the base part;

d) a lever frame for supporting a person thereon;

e) pivotation means for pivotally supporting the lever frame relative to the first upwardly extending part such that the lever frame is located substantially between the first and second upwardly extending parts; and f) engagement means, associated with the second upwardly extending part, for acting on the second upwardly extending part at a position higher than the lever frame so as to permit a person supported on the lever frame to engage with the engagement means to pivot the lever frame upwardly by way of the pivotation means against the force of the person's weight acting on the lever frame and to thereby lift the person supported on the lever frame, the engagement means including a first link pivotally connected at one end to the second upwardly extending part and having a free end; a second link pivotally connected at one end to the lever frame remote from the pivotation means and pivotally connected at its opposite end to the first link between said one end of the first link and said free end of the first link; and a gripping means associated with said free end of the first link for allowing a person to grip said gripping means to exert an upwardly directed pulling force to cause pivoting of the first link and to thereby lift the second link, to pivot the lever frame about the pivotation means and to thus lift a person supported on the lever frame.

2. A device as claimed in claim 1, in which the lever frame is adjustably supported by the pivotation means so as to vary the length of the lever.

* * * * *